US005235564A

United States Patent [19]

Fukuda et al.

[11] Patent Number: 5,235,564

[45] Date of Patent: Aug. 10, 1993

[54] SMALL-SIZED ELECTRONIC INSTRUMENT

[75] Inventors: Masami Fukuda; Mitsutoshi Nakamura; Junji Nagasawa; Kenichi Yoshikawa; Kouichi Nakajima, all of Tokyo; Fumio Kouyama, Saitama, all of Japan

[73] Assignee: Citizen Watch Co., Ltd., Tokyo, Japan

[21] Appl. No.: 764,840

[22] Filed: Sep. 24, 1991

[51] Int. Cl.[5] ..... G04C 23/02

[52] U.S. Cl. ..... 368/88; 368/318

[58] Field of Search ..... 368/87, 88, 220, 276, 368/280, 299–300, 316–318

[56] References Cited

U.S. PATENT DOCUMENTS

| | | | |
|---|---|---|---|
| 4,243,329 | 1/1981 | Nakayama | 368/76 |
| 4,437,768 | 3/1984 | Miyasaka | 368/88 |
| 4,788,669 | 11/1988 | Kamiyama | 368/80 |
| 4,876,677 | 10/1989 | Moriya | 368/87 |

FOREIGN PATENT DOCUMENTS 62-6552 2/1987 Japan .

*Primary Examiner*—Vit W. Miska

*Attorney, Agent, or Firm*—Koda and Androlia

[57] ABSTRACT

A small-sized electronic instrument such as an electronic wrist watch and others in which a plurality of parts are stacked and firmly held together by tightening a screw. The electronic instrument includes a base plate and a screw housing portion, which are integrally molded of a hard plastic material. The screw housing portion includes a bore formed therethrough and adapted to receive a self-tapping screw. When the self-tapping screw is threadingly received in the bore of the screw housing portion, a plurality of parts stacked around the screw housing portion are firmly tightened and held together. The screw housing portion has a shoulder including a step formed therein at the middle portion between the opposite ends. On assembly, the step engages one of the stacked parts. Even if the screw housing portion is pulled upwardly by the tightened self-tapping screw, the part sandwiched between the self-tapping screw and the step limits the upward movement of the screw housing portion on tapping. Thus, the screw housing portion can be prevented from being broken off from the base plate when the self-tapping screw is further tightened against the base plate.

7 Claims, 5 Drawing Sheets

SMALL-SIZED ELECTRONIC INSTRUMENT

BACKGROUND OF THE INVENTION

1. Field of the Invention

The present invention relates to a small-sized electronic instrument and particularly to the improved structure of a small-sized electronic instrument such as an electronic wrist watch or the like which utilizes a plastic base plate.

2. Description of the Related Art

Conventional small-sized electronic instruments, for example, electronic wrist watches have a base plate of metal material such as brass which can meet the dual requirements of sufficient strength and easy workability. FIG. 5 is a fragmentary cross-section of the assembled structure of a wrist watch mechanism having a metallic base plate.

In FIG. 5, the metallic base plate designated by reference numeral 10 includes a threaded tube 11 of metal press fitted thereinto from the bottom face of the base plate. The threaded tube 11 is used to position and tighten various parts relative to the base plate 10. The threaded tube 11 has a flange 11*a* formed therein at the bottom end, the flange 11*a* serving as a stop for preventing the threaded tube 11 from moving beyond the top of the base plate 10.

In the electronic wrist watch illustrated, the threaded tube 11 functions to position and hold a stator 12, a coil core 13, a coil terminal sheet 14, a composite circuit 15 and a gear train bridge 16 in the order described. These five parts are tightened together relative to the threaded tube 11 by a setscrew 17 threaded into the threaded bore of the threaded tube 11.

In such an arrangement, therefore, a number of parts can be assembled and held together by a few screws. This is advantageous particularly in the automated assembly process since the time and cost required to assemble various parts can be greatly reduced.

Recently, the utilization of molded plastics is increasing in such small-sized electronic instruments. The base plate is also frequently made of a plastic material such as engineering plastic or the like. However, there is still frequently used metallic threaded tubes each of which is press fitted into or molded into the base plate for providing sufficient strength and reliability in the certain part that will be subjected to a relatively large torque or a relatively large force exerted on the threaded tube in the direction of withdrawal.

In spite of the presence of this strength problem, a structure consisting of a base plate and threaded tube which are molded into a unit made from a plastic material is highly desired in the art for such reasons that a self-tapping screw can be used therein and that the manufacturing cost can be reduced. An example of such a base plate generally used in an electronic wrist watch is designated by reference numeral 20 in FIG. 6. The base plate 20 is made of a plastic material such as polycarbonate or the like and includes a sleeve-like screw housing portion 20*a* integrally molded therein at the positioning and holding location. As in the prior art of FIG. 5, around the outer periphery of the screw housing portion 20*a* are stacked a stator 21, a coil core 22, a coil terminal sheet 23 and a composite circuit 24, these parts being then firmly held relative to the screw housing portion 20*a* by a self-tapping type setscrew 25. As described, the screw housing portion 20*a* includes a bore 20*b* preformed centrally therethrough. The self-tapping screw 25 is threaded into the bore 20*b* of the screw housing portion 20*a* while tapping the bore 20*b*.

The structure of the base plate 20 with the screw housing portion 20*a* integrally molded therein serves to reduce the working or assembling cost. On the other hand, there is another problem in which the strength of the screw housing portion 20*a* is relatively low, leading to easy damage of the threads when tapping. More particularly, the polycarbonate material used to form the base plate 20 is relatively flexible and has its bending modulus of elasticity equal to about 50,000 $Kg/cm^2$. Therefore, such a plastic material may be easily damaged even if a relatively small torque such as about 250 g-cm is applied thereto as in the automated assembly process. In the automated assembly process, therefore, the tightening torque must be strictly controlled.

In addition, the damage of the threads in such tube members is frequently caused by repeated disassembly and assembly when repairing and overhauling small-sized electronic instruments.

Attempts have been made to overcome these problems by replacing the polycarbonate material with harder polyphenylene sulfide material or polythioether sulfone material. These hard plastic materials have a bending modulus of elasticity equal to about 100,000 $Kg/cm^2$, which is two times greater than that of said polycarbonate. Thus, threads are not damaged when self-tapping.

On the other hand, these hard plastic materials raise another problem in that the screw housing portion of the base plate made of the hard plastic material is easily cracked or broken at its root. The base plate of hard plastic material requires an increased wall thickness or any other reinforcing means at its screw housing portion. This increases the dimensions of the electronic instruments.

SUMMARY OF THE INVENTION

It is therefore an object of the present invention to provide an improved and simplified structure for a small-sized electronic instrument which can be manufactured with a reduced working and assembling cost and which can use a self-tapping screw without causing damage to threads and/or breaking of the tube portion.

Another object of the present invention is to provide an improved electronic instrument of small size which comprises a screw housing portion used to position and hold a plurality of parts in intimate contact with each other if required, these parts being firmly held together by the use of a single self-tapping screw.

To this end, the present invention provides a small-sized electronic instrument comprising a base plate made of plastic material and a sleeve-like screw housing portion molded integrally with the base plate, the screw housing portion having a bore formed therein for receiving a self-tapping screw, the screw housing portion also including a stepped shoulder formed therein around the outer periphery, the shoulder adapted to support one of a plurality of parts when they are positioned and stacked therearound and the self-tapping screw being then tightened relative to the screw housing portion to hold said one part against the shoulder of the screw housing portion directly or through the other parts of the stacked assembly of parts.

As a result, the screw housing portion will be tightened and held by the self-tapping screw through the part held against the shoulder. Therefore, the screw housing portion will not be subjected to any breaking force exerted from the base plate in a direction in which the tube portion is pulled on screw tightening. This reliably prevents the screw housing portion from being broken away from the base plate on screw tightening.

In another aspect of the present invention, the base plate and the screw housing portion formed integrally therewith can be molded of any hard plastic material. This can reliably prevent threads from being damaged on tapping.

DETAILED DESCRIPTION OF THE PREFERRED EMBODIMENT

Figure 1:
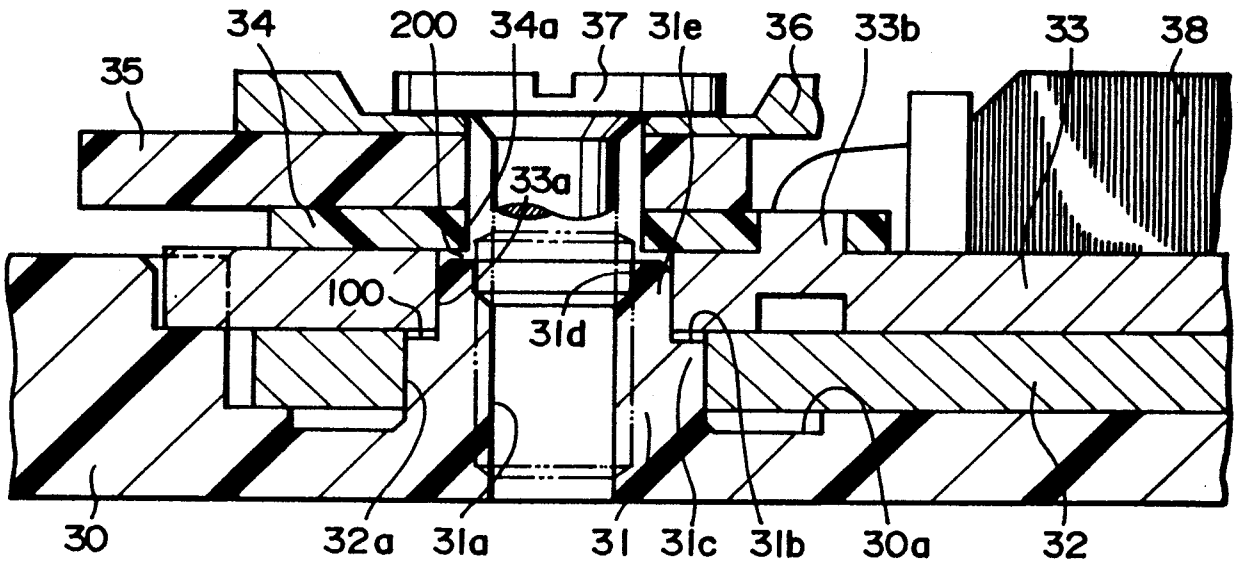
FIG. 1 is a fragmentary cross-section of the primary parts of a preferred embodiment of the present invention which is applied to the movement of an electronic wrist watch.
Figure 2:
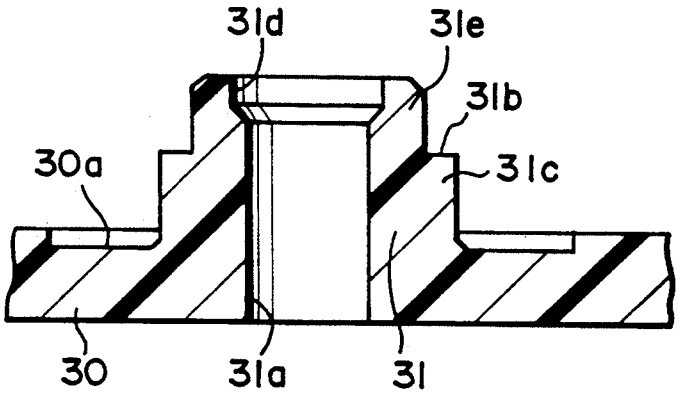
FIG. 2 is a fragmentary cross-section of a portion of the base plate with which a screw housing portion is integrally molded, in the preferred embodiment of FIG. 1.

Referring first to FIG. 1, there are shown the primary parts of an electronic wrist watch constructed in accordance with the present invention. The electronic wrist watch comprises a base plate 30 molded of an engineering plastic material and a screw housing portion 31 formed integrally with the base plate 30. As will be apparent from FIG. 1, the screw housing portion 31 includes a bore 31*a* formed centrally therethrough and adapted to receive a self-tapping screw. The screw housing portion 31 is shown to be a sleeve extending upwardly from the base plate 30.

The present invention is characterized by a shoulder 31*c* formed in the screw housing portion 31, the shoulder having a top step 31*b*. The shoulder 31*c* will engage a portion of one part in a plurality of parts to be stacked around the screw housing portion 31 and limit any upward displacement in the screw housing portion 31 within a range of displacement, as will be described in detail. The base plate 30 also includes a ring-shaped relief groove 30*a* formed therein around the screw housing portion 31. In this embodiment, when an upward force is exerted to the screw housing portion 31 on screw tightening, the relief groove 30*a* enables the screw housing portion 31 and the portion of the base plate 30 connected therewith to flex slightly upwardly. It is noted that the displacement in the screw housing portion 31 mainly results from its own tension. The configuration and dimension of the relief groove 30*a* depends on various molding and working conditions as well as dealing with the tightening structure or the diameter of the tube root.

In this embodiment, the base plate 30 is preferably molded of a relatively hard plastic material and more preferably of polythioether sulfones. At present, polythioether sulfone or polyphenylene sulfide is used as a preferred material.

In this embodiment, the screw housing portion 31 further includes a thread guide 31*d* formed therein by partially cutting into the top inner edge of the bore 31*a* of the screw housing portion 31 such that a tapping screw can easily bite the inner wall of the bore 31*a*. This prevents the lead portion 31*e* of the screw housing portion 31 which is reduced in thickness due to the forming of the top step 31*b*, from being damaged by the tapping screw when it bites the bore 31*a* of the screw housing portion 31.

Figure 3:
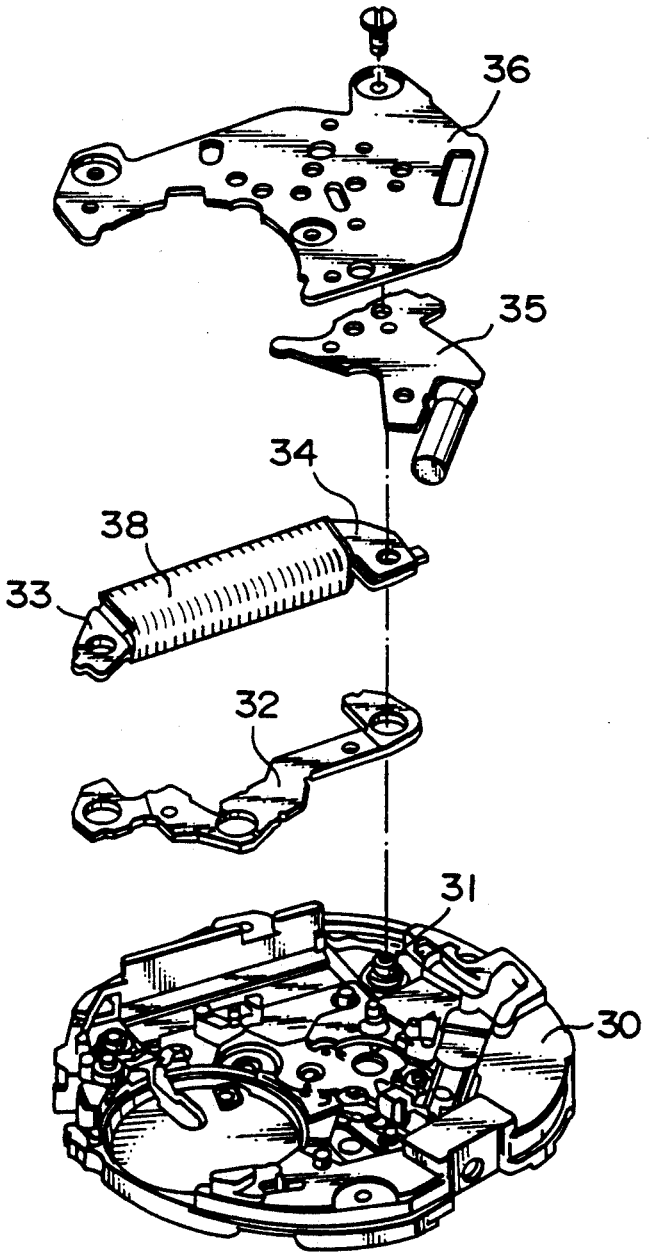
FIG. 3 is an exploded and perspective view of various essential parts of the preferred embodiment before being assembled.
Figure 4:
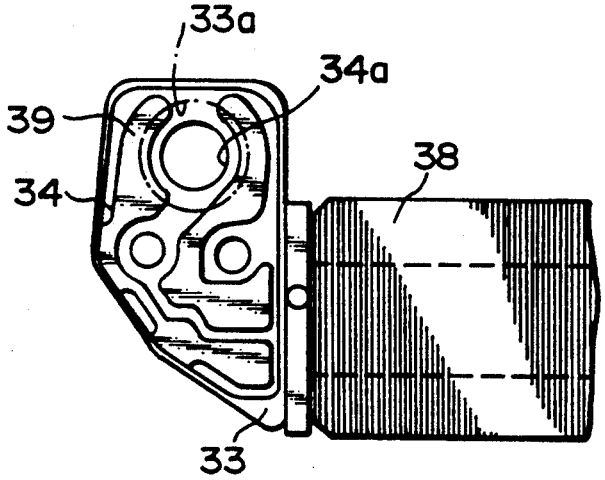
FIG. 4 is a plan view of a coil terminal sheet mounted on a coil.
Figure 5:
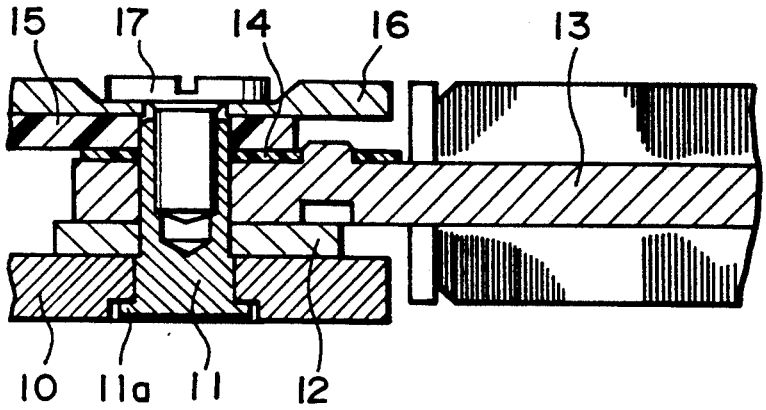
FIG. 5 PRIOR ART
FIG. 5 is a fragmentary cross-section of the primary parts in an electronic wrist watch constructed in accordance with the prior art.
Figure 6:
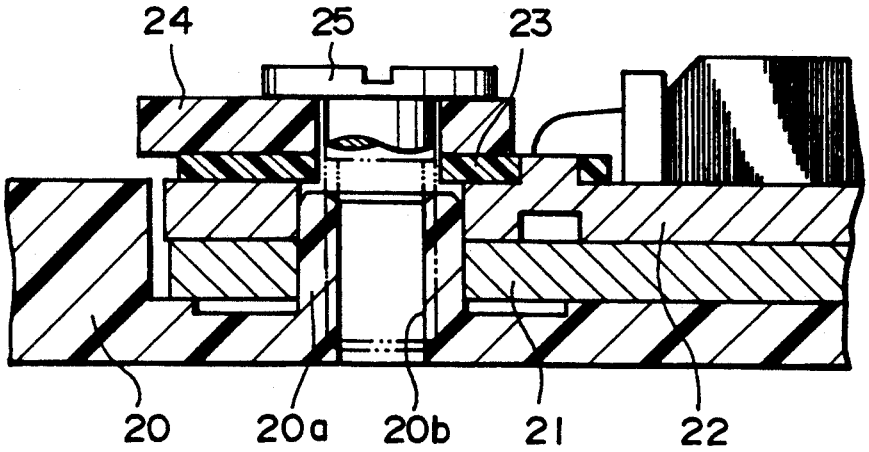
FIG. 6 PRIOR ART
FIG. 6 is a view similar to FIG. 5, illustrating the primary parts of another electronic wrist watch constructed in accordance with the prior art.

The screw housing portion 31 thus formed provides means for positioning and holding a plurality of parts stacked therearound. As shown in FIGS. 1 and 3, a stator 32, a coil core 33, a coil terminal sheet 34, a composite circuit 35 and a gear train bridge 36 are sequentially stacked around the screw housing portion 31 on assembly. The uppermost bridge 36 will be tightened and held relative to the screw housing portion 31 and the remaining parts when the tapping screw 37 is tightened into the bore 31*a* of the screw housing portion 31. As a result, all the stacked parts can be firmly positioned and held against the screw housing portion 31. The assembling operation will be carried out as follows:

First of all, the stator 32 is assembled onto the base plate 30. The stator 32 includes a positioning opening 32*a* formed therein and having its internal diameter slightly larger than the external diameter of the screw housing portion 31. Thus, the stator 32 can be easily assembled onto the base plate 30 around the screw housing portion 31 by causing the positioning opening 32*a* to align with the screw housing portion 31. In accordance with the present invention, it is of course possible to form the positioning opening 32*a* into an internal diameter substantially larger than the external diameter of the screw housing portion 31. In such a case, the stator 32 may be properly positioned relative to the base plate 30 by using any other positioning means. The positioning opening 32*a* of the stator 32 also serves as a stop for preventing any further movement of the stator 32 on the base plate 30.

In this embodiment, the thickness of the stator 32 is selected to be slightly larger than the height of the shoulder 31*c* of the screw housing portion 31. This results in a small gap 100 between the top face of the stator 32 and the bottom face of the coil core 33. On the final screw tightening step, the screw housing portion 31 will be pulled upwardly until the gap 100 is fully collapsed. The shoulder 31*c* then contacts the coil core 33 to limit any further upward movement of the screw housing portion 31. In addition, the stator 32 is firmly sandwiched and held between the coil core 33 and the base plate 30.

The gap may be formed to have a height equal to or more than 25 μm. Such a gap can reliably accommodate any tolerance in the parts.

It is of course to be understood that if the stator 33 is not required to be sandwiched between the coil core 33 and the base plate 30, the gap can be omitted. On initiation of the tightening by the setscrew 37, the coil core 33 may engage the shoulder 31*b* of the screw housing portion 31 such that any upward tensioning force exerted to the screw housing portion 31 on screw tightening can be eliminated initially.

When the self-tapping screw 37 penetrates into the screw housing portion 31, the latter is expanded slightly. At this time, there may be created a tightness between the outer periphery of the screw housing portion 31 and the positioning opening 32*a* of the stator 32 or the positioning opening 33*a* of the coil core 33. However, such a tightness can be accommodated by the deformation of the gap formed between the outer periphery of the screw housing portion 31 and the positioning opening of the associated part. The relief groove 30*a* of the base plate 30 also serves to prevent the stator 32 from being lifted due to any fine irregularity which may be present in the interface between the stator 32 and the base plate 30.

After the stator 32 has been assembled onto the base plate 30, the coil core 33 is then assembled onto the stator 32 with the positioning opening 33*a* being aligned with the outer periphery of the top lead portion 31*e* of the screw housing portion 31. Since a gap is formed between the internal diameter of the positioning opening 33*a* and the external diameter of the lead portion as described, the assembling can be easily carried out. Even if the lead portion 31*e* is slightly expanded by the tapping, any tightness may be avoided by the deformation of the gap on tapping. As will be apparent from the drawings, the coil core 33 includes a coil 38 wound therearound and functioning as mechanism for moving the hands in the electronic watch the electronic wrist watch. Such a coil 38 also can be reliably positioned relative to the base plate 30.

In the illustrated embodiment, the thickness of the coil core 33 is selected to be sufficiently larger than that of the lead portion 31*e* of the screw housing portion 31. This results in the creation of a sufficient gap 200 between the bottom face of the coil terminal sheet stacked on the coil core 33 and the top face of the screw housing portion 31. This gap 200 is selected to have a thickness at least larger than that of the gap 100 formed between the shoulder 31*c* and the bottom face of the coil core 33. When the screw housing portion 31 is pulled upwardly on tightening of the self-tapping screw 37, the shoulder 31*c* will reliably engage the bottom face of the coil core 33 to prevent the screw housing portion 31 from being broken off.

Thus, a circuit pattern 39 can be formed widely over the surface of the coil terminal sheet 34, leading to easy designing of the circuit. It is of course that the increased degree of freedom provides an advantage in that the electrical junction between the coil terminal sheet 34 and the composite circuit 35 can be increased in size, so requiring a reduced accuracy.

As a combination of the coil core 33 with the coil terminal sheet 34 incorporated thereinto is incorporated onto the base plate 30, the coil terminal sheet 34 is positioned relative to the coil core 33 through a boss 33*b* formed therein. In such a manner, the composite circuit 35 is assembled onto the coil terminal sheet 34 and thereafter the gear train bridge 36 is assembled onto the composite circuit 35.

Finally, the self-tapping screw 37 is threadingly inserted into the bore 31*a* of the screw housing portion 31 to hold all the assembled parts together against the base plate 30.

In the illustrated embodiment, the screw housing portion 31 is molded integrally with the base plate 30 from the same plastic material. If this molding is made of one of the polyphenylene sulfides, the screw housing portion 31 will have a bending modulus of elasticity equal to or higher than about 100,000 Kg/cm$^2$. Thus, the threads in the screw housing portion 31 will not be damaged on tapping, or even if the screw housing portion 31 is subjected to repeated tightening and loosening. This provides an electronic wrist watch which is durable for a prolonged period even if it is repeatedly disassembled and re-assembled for replacement and repair.

When the leading end of the setscrew 37 bites the bore 31*a* of the screw housing portion 31, the initial engagement is accomplished at a position below the thread guide 31*d* of the screw housing portion 31. Therefore, the lead portion 31*e* reduced in thickness by forming the shoulder 31*c* will not be exposed to the tapping force. This reliably prevents the screw housing portion 31 from being broken off from the base plate 30.

It is, however, preferred that the minimum thickness of the lead portion 31*e* is equal to or larger than 100 μm.

As all the stacked parts are firmly tightened and held by the setscrew 37, the screw housing portion 31 is slightly pulled upwardly by the tightening force, with the shoulder 31*c* being engaged by the bottom of the coil core 33. In other words, the gap 100 is fully collapsed. Under such a condition, the screw housing portion 31 will no longer be pulled upwards. This provides an advantage in that even if the screw housing portion 31 is molded of a hard plastic material, it will not be displaced upwardly on tapping.

In the illustrated embodiment, the shoulder 31*c* may be damaged by the contact of the shoulder 31*c* with the coil core 33 if the width of the shoulder 31*c* is too small. It is therefore preferred that the width of the shoulder 31*c* is selected to be equal to or larger than 100 μm.

In small-sized electronic instruments such as electronic wrist watches and others, it is preferred that the external maximum diameter of the screw housing portion 31 is relatively small. In the illustrated embodiment, the maximum external diameter of the screw housing portion 31 is preferably selected to be equal to or less than 2000 μm.

It is desirable that the tapping screw 37 is coaxially introduced into the bore 31*a* of the screw housing portion 31. If there is any inclination in the bore 31*a*, the tapping cannot be properly carried out. In the illustrated embodiment, the introduction of the tapping screw 37 can be easily accomplished by the use of the thread guide 31*d* of the lead portion 31*e*. Further, since the actual tapping is carried out at a position below the thread guide 31*d*, any cracking and/or breaking of the plastic material at the thin-walled lead portion 31*e* can be reliably prevented.

The aforementioned engagement of the shoulder 31*c* of the screw housing portion 31 with the bottom face of the coil core 33 when the tapping screw 37 threadingly engages the bore 31*a* of the screw housing portion 31 will be described in more detail in connection with the advantages thereof.

As the tapping screw 37 is moved into the bore 31*a* of the screw housing portion 31, the latter is forced upwardly by the tapping screw 37. In the prior art, this may break the root of the screw housing portion 31. In accordance with the present invention, however, the step 31*b* of the shoulder 31*c* will be moved upwardly by the amount corresponding to the gap 100 and so collapse it. After the step 31*b* has been engaged by the coil core 33, the bottom face of the coil core 33 arrests the deformation of the screw housing portion 31. Consequently, the aforementioned problems of damage can be reliably overcome.

The position of the step 31*b* can be varied arbitrarily.

The step 31*b* of the screw housing portion 31 is also important for the assembling process in accordance with the present invention. When the screw housing portion 31 is molded integrally with the base plate 30, however, the step 31*c* can be properly and easily formed on the screw housing portion 31 at its middle position spaced away from the top end thereof.

Unlike the screw housing portion of the base plate constructed according to the prior art which would be broken by a tightening torque as small as 250 g-cm, the screw housing portion 31 of the present invention can be broken only by a tightening torque equal to or more than about 400 g-cm.

In the illustrated embodiment, the parts stacked at least above the step of the screw housing portion are intimately sandwiched together between the screw housing portion and the tapping screw, and so the electrical connection such as between the coil terminal sheet 34 and the composite circuit 35 can be reliably secured.

Since the base plate is made of plastic material, the threads can be formed directly in the base plate without the need for press fitting of any metallic threaded tube or the like, resulting in a reduction in the manufacturing and assembling cost of parts. The aforementioned problems of deforming, cracking, breaking and others which are created when the tapping screw penetrates the base plate of hard plastic material can be overcome without an increase in size or thickness and also without impasing a limitation on the design. Therefore, the present invention can provide electronic instruments which are stable in quality.

We claim:

1. A small-sized electronic instrument comprising:

A. a base plate made of a plastic material; and

B. a screw housing portion molded integrally with said base plate, said screw housing portion including a bore formed centrally therethrough, said bore adapted to receive a self tapping screw;

C. said screw housing portion including a shoulder formed therein, said shoulder having a step formed therein at the outer periphery, the shoulder of said screw housing portion being adapted to support one of a plurality of parts positioned and stacked around said screw housing portion, said supported part being tightened and held against said base plate directly or through the other stacked parts when the self-tapping screw is threadingly inserted into said bore;

D. a small gap formed between the shoulder of said screw housing portion and said one supported part before they are tightened together by said self-tapping screw;

E. another small gap formed between the top of said screw housing portion and the bottom of the lower most stacked part before they are tightened together by said self-tapping screw; and F. said small gap between the shoulder of said housing portion and said one supported part is smaller than said another small gap between a top of said screw housing portion and said bottom of the lower most stacked part.

2. A small-sized electronic instrument as defined in claim 1, wherein said base plate is made of a hard plastic material.

3. A small-sized electronic instrument as defined in claim 1, further comprising a ring-shaped groove formed in said base plate around said screw housing portion; whereby said screw housing portion can be easily deformed to collapse said gap when said self-tapping screw is threadingly inserted into the bore of said screw housing portion.

4. A small-sized electronic instrument as defined in claim 1, wherein said screw housing portion includes a thin-walled lead portion formed therein at a position above said shoulder, at least a portion of said lead portion being not engaged by said self-tapping screw when it is threadingly inserted into the bore of said screw housing portion.

5. A small-sized electronic instrument as defined in claim 1, wherein said shoulder has a width equal to at least 100 μm when the external maximum diameter of said screw housing portion is equal to or less than 2000 μm.

6. A small-sized electronic watch as defined in claim 1 wherein the parts sandwiched and held between the shoulder of said screw housing portion and the self-tapping screw include a stator and a magnetic coil core, whereby the magnetic connection therebetween can be secured.

7. A small-sized electronic watch as defined in claim 1 wherein the parts sandwiched and held between the shoulder of said screw housing portion and the self-tapping screw include at least a coil terminal sheet and a composite circuit, whereby the electrical connection therebetween can be secured when they are tightened together by the self-tapping screw.

* * * * *

UNITED STATES PATENT AND TRADEMARK OFFICE

CERTIFICATE OF CORRECTION

PATENT NO. : 5,235,564

DATED : August 10, 1993

INVENTOR(S) : Masami Fukuda, et al.

It is certified that error appears in the above-identified patent and that said Letters Patent is hereby corrected as shown below: On the title page: Item

[75] Inventors: Change "Masami Fukuda; Mitsutoshi Nakamura; Junji Nagasawa; Kenichi Yoshikawa; Kouichi Nakajima, all of Tokyo; Fumio Kouyama, Saitama, all of Japan" to --Masami Fukuda; Mitsutoshi Nakamura; Takeo Mutou; Junji Nagasawa; Kenichi Yoshikawa; Kouichi Nakajima, all of Tokyo; Fumio Kouyama, Saitama, all of Japan--

Signed and Sealed this

Twenty-second Day of March, 1994

*Attest:*

Bruce Lehman

BRUCE LEHMAN

*Attesting Officer*

*Commissioner of Patents and Trademarks*